US008007206B1

(12) United States Patent
Spearing

(10) Patent No.: US 8,007,206 B1
(45) Date of Patent: Aug. 30, 2011

(54) LOW PROFILE CABLE BOLT HEADERS

(75) Inventor: Anthony John Spencer Spearing, Caterville, IL (US)

(73) Assignee: Excel Mining Systems LLC, Bowerston, OH (US)

( * ) Notice: Subject to any disclaimer, the term of this patent is extended or adjusted under 35 U.S.C. 154(b) by 0 days.

(21) Appl. No.: 12/002,316

(22) Filed: Dec. 14, 2007

Related U.S. Application Data

(63) Continuation-in-part of application No. 11/825,850, filed on Jul. 9, 2007, now abandoned.

(60) Provisional application No. 60/819,134, filed on Jul. 7, 2006.

(51) Int. Cl.
*E21D 20/00* (2006.01)

(52) U.S. Cl. ..... 405/259.1

(58) Field of Classification Search ..... 405/259.1, 405/302.1, 302.2, 259.2–259.6; 403/195, 403/304, 314; 52/223.13, 223.14
See application file for complete search history.

(56) References Cited

U.S. PATENT DOCUMENTS

| | | | | |
|---|---|---|---|---|
| 4,140,428 | A * | 2/1979 | McLain et al. | 405/259.6 |
| 5,230,589 | A | 7/1993 | Gillespie | |
| 5,253,960 | A * | 10/1993 | Scott | 405/302.2 |
| 5,259,703 | A | 11/1993 | Gillespie | |
| 5,829,922 | A * | 11/1998 | Calandra et al. | 405/302.2 |
| 6,056,482 | A * | 5/2000 | Calandra et al. | 405/302.2 |
| 6,322,290 | B1 * | 11/2001 | Calandra et al. | 405/259.1 |
| 7,588,394 | B1 | 9/2009 | Walker et al. | |
| 7,802,943 | B2 | 9/2010 | Walker et al. | |
| 2006/0096196 | A1 * | 5/2006 | Hayes et al. | 52/223.13 |
| 2007/0036617 | A1 | 2/2007 | Oldsen et al. | 405/302.1 |

OTHER PUBLICATIONS

Jennmar Crater Plate/Bit System, 2005, (http://www.jennmar.com/products/craterplate_bitsystem.html; http://www.jennmar.com/products/print_friendly/pf_craterplate_bitsystem.html; http://www.jennmar.com/images/products/enlarge/bit.jpg).

* cited by examiner

*Primary Examiner* — John Kreck
*Assistant Examiner* — Sean Andrish
(74) *Attorney, Agent, or Firm* — Reed Smith LLP

(57) ABSTRACT

Improved roof cable bolts with reduced protrusion from a mine roof. Particularly, a roof cable bolt head can preferably be dimensioned such that most of its length fits inside a drilled hole in the mine roof.

4 Claims, 7 Drawing Sheets

SECTION A-A

LOW PROFILE CABLE BOLT HEADERS

CROSS-REFERENCE TO RELATED U.S. APPLICATIONS

This application is a continuation-in-part of U.S. patent application Ser. No. 11/825,850, filed on Jul. 9, 2007 now abandoned, the contents of which are hereby incorporated by reference, which itself claims the benefit under 35 U.S.C. §119(e) of the earlier filing date of U.S. Provisional Application Ser. No. 60/819,134 filed on Jul. 7, 2006, which is also hereby incorporated by reference.

FIELD OF THE INVENTION

The present invention relates generally to roof bolts in the mining arts, particularly roof cable bolts, and challenges encountered in connection with their installation and use.

BACKGROUND OF THE INVENTION

In the mining arts, roof cable bolts are often employed to strengthen and stabilize a mine roof. Typically, after a cable bolt is installed in a drilled hole, a plate and head protrude from the hole. The top of a protruding head is normally configured for being engaged with a tool that can rotate the cable into the hole and mix resin cartridges, thereby setting the cable fast in the drilled hole.

A problem is commonly encountered in the context of coal seams that are sufficiently small as to result in low heights for mines or tunnels in the seam. Particularly, a problem of low clearances, e.g., for equipment and workers, becomes even worse. Since the head and wedges from a conventional cable bolt can protrude, e.g., 2 or 3 inches (or more) downwardly from the mine roof, a significant hazard is presented to people and equipment in the mine.

Jennmar Corporation, based in Pittsburgh, Pa., has developed a system with the following characteristics:

- the use of a collared crater hole;
- the use of a dust boot when drilling a collared crater hole using a special tool (see FIG. 4*b*) to collect dust from the cratering action; and
- the use of an inverted dome crater plate with a conventional head.

However, this arrangement involves a level of complexity that adds time and cost to the installation process (as will be more fully appreciated herebelow), including the need for a dedicated process step to form the crater hole.

A need has thus been recognized in connection with realizing bolt installation arrangements and processes that avert such complexity.

SUMMARY OF THE INVENTION

In accordance with at least one embodiment of the present invention, in order to mitigate the problems described heretofore (among others), a roof cable bolt head can preferably be dimensioned such that most of its length fits inside a drilled hole in the mine roof. Again, the end result is that a low profile cable bolt would be provided to mines at literally no extra cost or effort to the end user, unlike the crater plate system mentioned heretofore.

In summary, there is broadly contemplated herein, in accordance with at least one presently preferred embodiment of the present invention, a roof bolt head comprising: a first section adapted for insertion into a roof hole; a second section adapted for accommodating a tightening tool; and a throughhole for accommodating a bolt portion; the throughhole extending through both the first and second sections; the first and second sections being fixedly connected with one another.

Further, there is broadly contemplated herein, in accordance with at least one presently preferred embodiment of the present invention, a roof cable bolt comprising: a cable bolt body; a cable bolt head disposed at an end of the cable bolt body; the cable bolt head comprising: a first section adapted for insertion into a roof hole; a second section adapted for accommodating a tightening tool; and a throughhole which accommodates the cable bolt body; the throughhole extending through both the first and second sections; the first and second sections being fixedly connected with one another.

Additionally, there is broadly contemplated herein, in accordance with at least one presently preferred embodiment of the present invention, a method of installing a roof cable bolt, the method comprising the steps of: providing a roof cable bolt comprising: a cable bolt body; and a cable bolt head disposed at an end of the cable bolt body, the cable bolt head comprising a first section adapted for insertion into a roof hole, a second section adapted for accommodating a tightening tool, and a throughhole which accommodates the cable bolt body, the throughhole extending through both the first and second sections, the first and second sections being fixedly connected with one another; disposing the cable bolt body and the first section of the cable bolt head into a roof hole; and rotating the second section of the cable bolt head with a tightening tool.

The novel features which are considered characteristic of the present invention are set forth herebelow. The invention itself, however, both as to its construction and its method of operation, together with additional objects and advantages thereof, will be best understood from the following description of the specific embodiments when read and understood in connection with the accompanying drawings.

BRIEF DESCRIPTION OF THE DRAWINGS

For the present invention to be clearly understood and readily practiced, the present invention will be described in conjunction with the following figures, wherein like reference characters designate the same or similar elements, which figures are incorporated into and constitute a part of the specification.

DESCRIPTION OF THE PREFERRED EMBODIMENTS

It is to be understood that the figures and descriptions of the present invention have been simplified to illustrate elements that are relevant for a clear understanding of the invention, while eliminating, for purposes of clarity, other elements that may be well known. The detailed description will be provided herebelow with reference to the attached drawings.

Figure 1A:
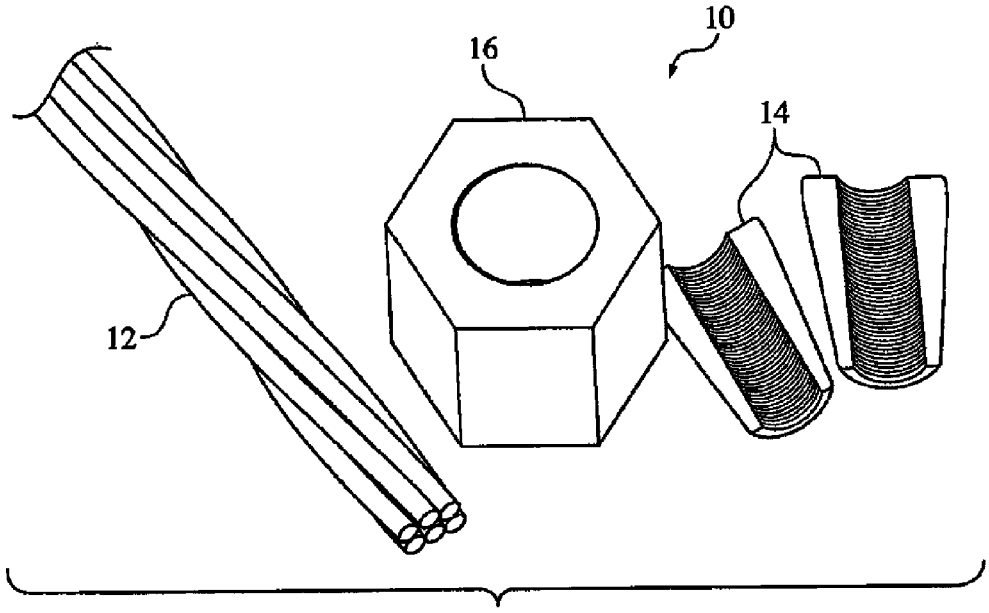
FIG. 1a (PRIOR ART)
FIG. 1*a* illustrates pieces of typical cable bolt ends as known in the mining arts.
Figure 1B:
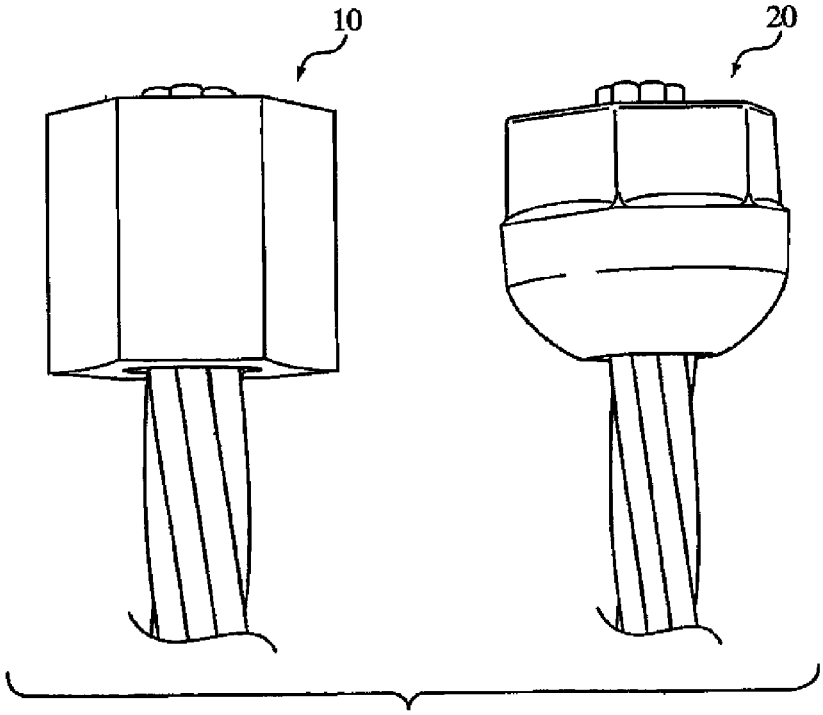
FIG. 1b (PRIOR ART)
FIG. 1*b* illustrates assembled versions of typical cable bolt ends as known in the mining arts.

Typical cable bolt ends, as known in the mining arts, are illustrated in FIGS. 1*a/b*. As shown in FIG. 1*a*, a cable (i.e., a roof cable bolt as known in the mining arts) is normally integrable with 2 or 3 wedges, which themselves fit into the interior diameter of a (e.g. hexagonal) head. FIG. 1*b* shows such components assembled, in two well known exterior design incarnations.

Figure 2A:
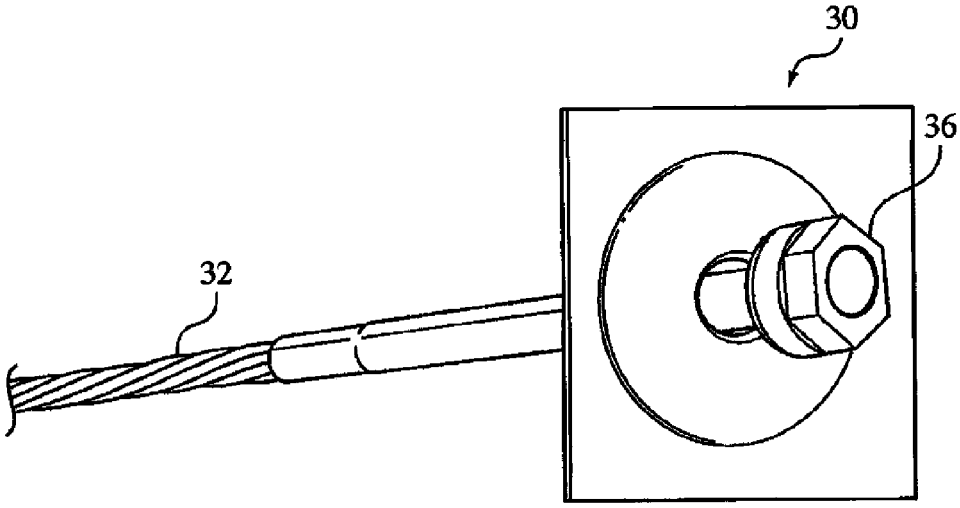
FIG. 2a (PRIOR ART)
FIGS. 2*a* and 2*b* respectively show two different assembled conventional cable bolts with plates.
Figure 2B:
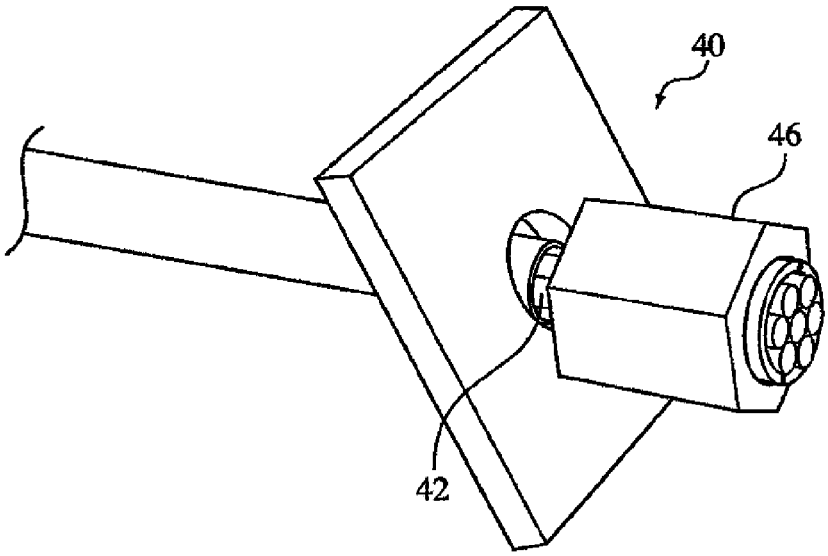
FIG. 2b (PRIOR ART)

Typically, after a cable bolt is installed in a drilled hole, the plate and head protrude from the hole. FIGS. 2*a/b* (which respectively show two more or less equivalently functioning incarnations) help illustrate this phenomenon. Typically, at least the top of each head is hexagonal so that the drill rig (normally fitted with a hexagonal wrench/spanner fitting) can rotate the cable into the hole and mix the resin cartridges, thereby setting the cable fast in the drilled hole. (FIG. 2*b* shows a cable bolt with a cylindrical sheath—a small end portion of which is visible—disposed about the bolt.)

Figure 3:
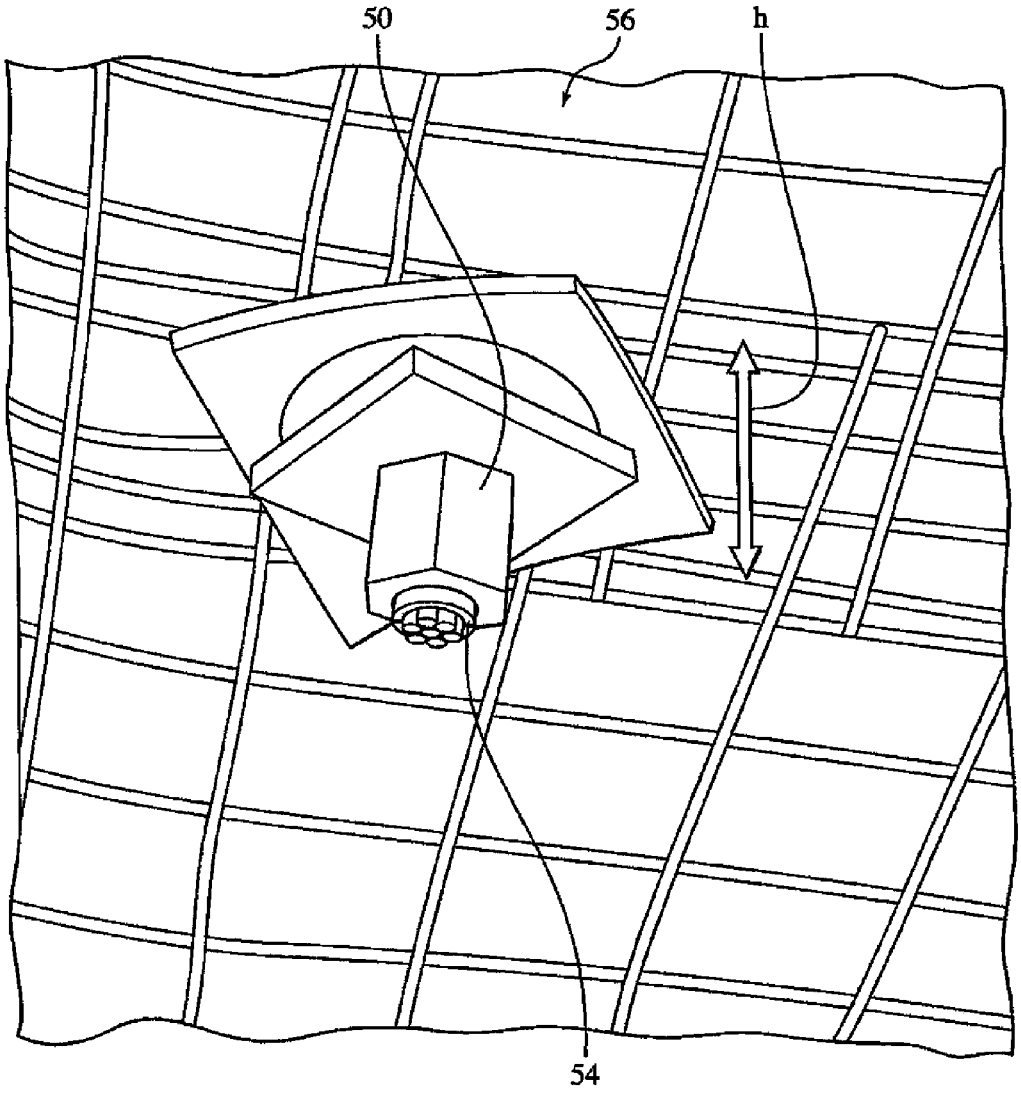
FIG. 3 (PRIOR ART)
FIG. 3 illustrates a problem involving the protrusion of a conventional cable bolt from a roof.

FIG. 3 illustrates a commonly encountered problem as mentioned further above. Particularly, in the context of coal seams that are sufficiently small as to result in low heights for mines or tunnels in the seam, a problem of low clearances, e.g., for equipment and workers, becomes even worse. Particularly, since the head and wedges from a conventional cable bolt can protrude, e.g., 2 or 3 inches (or more) downwardly from the mine roof, a significant hazard is presented to people and equipment in the mine.

Figure 4A:
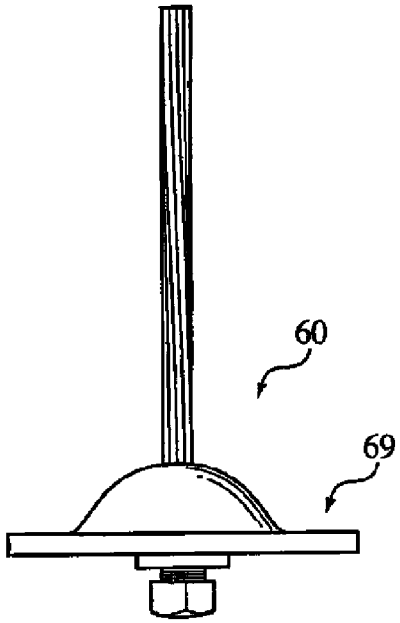
FIG. 4a (PRIOR ART)
FIGS. 4*a* and 4*b* illustrate components from another conventional method.
Figure 4B:
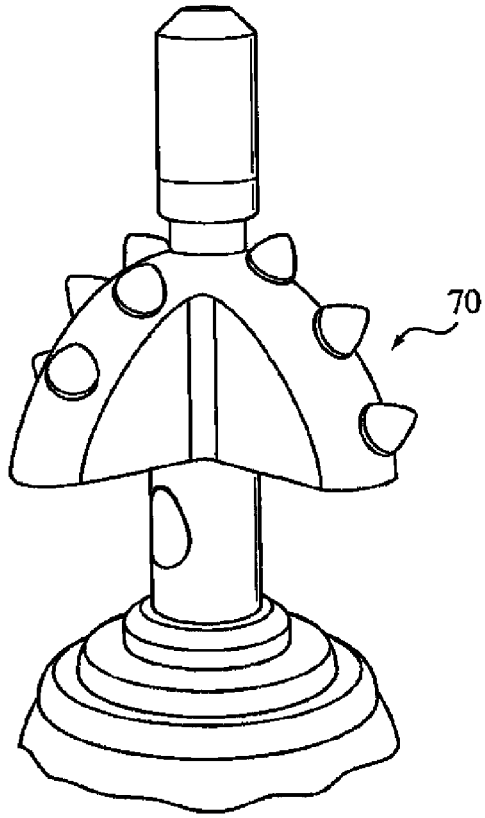
FIG. 4b (PRIOR ART)

The features of the aforementioned Jennmar system can be appreciated from FIGS. 4*a* and 4*b*, which makes some strides in addressing the problem just outlined. Essentially, such a crater plate system just involves a specially designed countersinking drill bit (as seen in FIG. 4*b*) and an engineered high strength plate (as evident in FIG. 4*a*).

FIG. 4*a*, as such, shows a conventional cable bolt end and plate while FIG. 4*b* shows the aforementioned drill attachment which forms a crater to be disposed at the initial opening of a roof hole, whereby the reverse crater plate will fit into this crater. After the crater has been formed by the tool in FIG. 4*b*, the rest of the hole is drilled (to a correct, desired length) using conventional drilling rods and bits. The result is that an installed bolt may likely protrude only about one inch from the plate. However, as mentioned previously, this arrangement involves a level of complexity that adds time and cost to the installation process, especially since the initial cratering operation represents yet another operation that needs to be undertaken.

Figure 5:
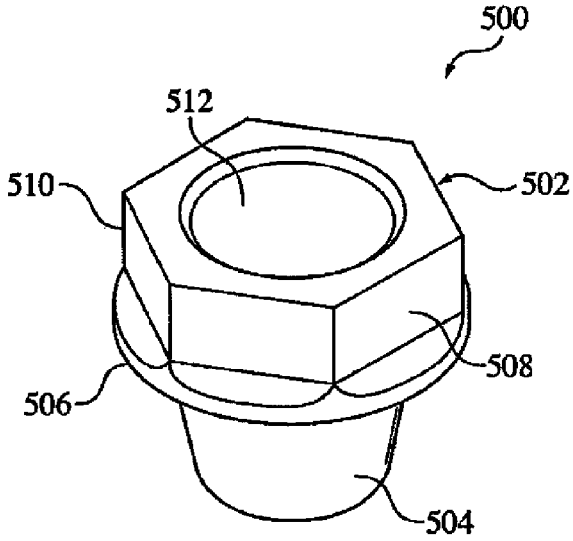
FIG. 5 illustrates, in perspective view, a low profile cable bolt head.

FIG. 5 shows, in perspective view, a low profile cable head design in accordance with a preferred embodiment of the present invention. Cable bolt head 500 preferably includes, as shown, a hexagonal profile portion 502 and a circular profile (or frustoconical) portion 504. The view in FIG. 5 is essentially "upside down", in that the hexagonal portion 502 would most often protrude downwardly from a roof while circular/frustoconical portion 504 would extend into a roof hole. Hexagonal portion 502 includes six faces 508 as shown, which meet at edges 510.

Preferably, an optional circular disc portion (or lip) 506 can be disposed at the transition between hexagonal portion 502 and circular/frustoconical portion 504. (The term "circular", as used with regard to component 504 and analogous components discussed herein, is intended to convey at least the concept of a circular cross-section of a portion when the portion is cut at an angle perpendicular to a central longitudinal axis of the portion in question.) Circular disc portion 506 essentially ensures that the head 500 can fit into a roof hole (or installation socket) of appropriate diameter without "over-deploying" into the hole in such a way that the head 500 would end up being disposed not sufficiently tightly or snugly against the roof.

Figure 6:
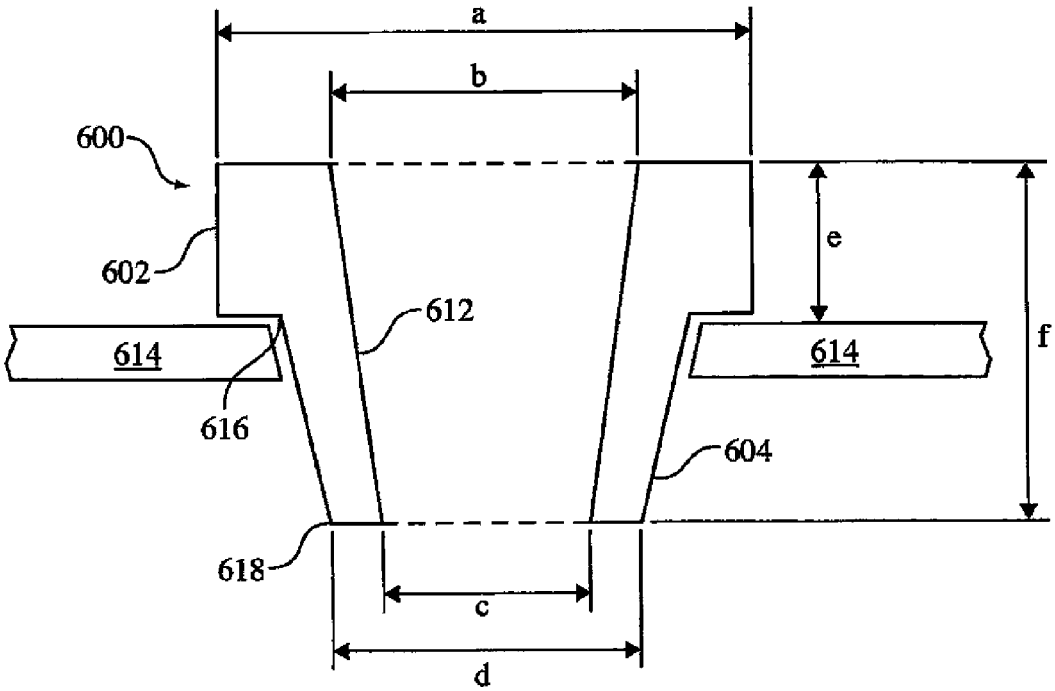
FIG. 6 shows a cross-sectional view of a low profile cable bolt head.

Also shown is an frustoconical throughhole 512 that preferably extends substantially all the way from an uppermost portion of head 500 to a lowermost portion, even through the transition between hexagonal portion 502 and circular/frustoconical portion 504; this will be better appreciated in FIG. 6.

For its part, FIG. 6 shows, in a cross-sectional view, a low profile cable bolt head 600 configured in accordance with a presently preferred embodiment of the present invention; it will be appreciated that FIG. 6 has similar components to the head 600 shown in FIG. 5. The cross-section in FIG. 6 is taken such that it cuts two opposing apices of a hexagonal profile (i.e., point-to-point across a maximum diameter of a hexagonal profile; in FIG. 5 this would be between two opposing edges 510). In FIG. 6, there is no circular disc or lip portion analogous to component 506 of FIG. 5.

Also indicated in FIG. 6 are some dimensional variables a through f. Some non-restrictive and illustrative examples of such dimensions will be provided herebelow. It should further be understood that an appreciation of the relative dimensions involved, in the context of the mining arts, will certainly assist in highlighting the advantages associated with embodiments of the present invention. (As such, it should be noted that FIG. 6 is not necessarily drawn to scale.) Components in FIG. 6 that are analogous to those shown in FIG. 5 have reference numerals advanced by 100 as compared to FIG. 5.

As shown, a circular/frustoconical portion 604 transitions into hexagonal portion 602 such that the protrusion distance of head 600 beyond a roof plate 614 is small. (It should further be noted that as in FIG. 5 the view in FIG. 6 is essentially "upside down"; the hexagonal portion 602 would most often protrude downwardly from a roof while circular/frustoconical portion 604 would extend into a roof hole.)

By way of example, height dimension e, representing a net protrusion of head 600 beyond plate 614, could be about a mere 0.75 inch in accordance with at least one embodiment of the present invention, which represents a tremendous stride in providing additional vertical clearance for personnel in a mine. (Assuming that the thickness of plate 614 is about 0.25 inch or less, the total material protrusion from a mine roof will be less than or equal to about one inch.) At the same time, since all that is involved here essentially is a modification in the shape of the head, the installation process scarcely changes (in comparison with conventional arrangements other than the Jennmar crater plate system mentioned above), thus ensuring that the installation cost scarcely changes.

The upper maximum diameter a (apex to apex) of hexagonal portion 602 could be about 1.75 inches. At the same time, an increase in this dimension to 2.00 inches could provide an even more adequate surface area for holding the plate 614 securely (though it will be appreciated that this may necessitate a larger cable bolt, e.g., 0.6 inch in diameter, and thus a larger installation socket).

Other dimensions may be chosen and employed in a manner to provide degrees of strength and anchorage that may be desired. In a typical (albeit illustrative and non-restrictive) application, a maximum diameter b of frustoconical throughhole 612 could be about 1.13 inches and a minimum diameter c, about 0.72 inches. A minimum outer diameter d of circular/frustoconical portion 604, on the other hand, could be about 1.10 inches. Finally, an overall height dimension f of head 600 could be about 1.75 inches.

In a variant configuration, by way of an additional illustrative and non-restrictive example, essentially the same basic design as shown as in FIG. 6 (i.e., a circular profile transitioning into a hexagonal profile) may be provided, yet with an even narrower inner profile. Accordingly, height dimension f could increase to about 1.90 inches while diametric dimensions c and d could be reduced to about 0.64 inch and about 1.00 inch, respectively. With such a configuration, a protrusion of about 0.75 inch of head 600 beyond plate 614 (dimension e) could still be attained, while, with an approximate 0.25 inch (or less) thickness of plate 614 the result again would be a net protrusion of 1 inch or less (of head 600 beyond plate 614).

Optionally, a transitional corner 616 (between hexagonal portion [with or without a transitional disc portion] 602 and circular/frustoconical portion 604) and a terminal circular edge 618 (of circular/frustoconical portion 604) could be rounded (i.e., provided with radii), but this is not essential.

It will be appreciated from the examples of FIGS. 5 and 6 that a cable head, formed in accordance with at least one embodiment of the present invention, can be configured and dimensioned such that most of its length would fit inside the drilled hole in the mine roof (and would thus dig into the hole during the process of installing the cable bolt, via the drill rotation that mixes the resin). Again, the end result is that a low profile cable bolt would be provided to mines at literally no extra cost or effort to the end user, unlike the crater plate system mentioned heretofore (see FIGS. 4*a/b*).

Figure 7A:
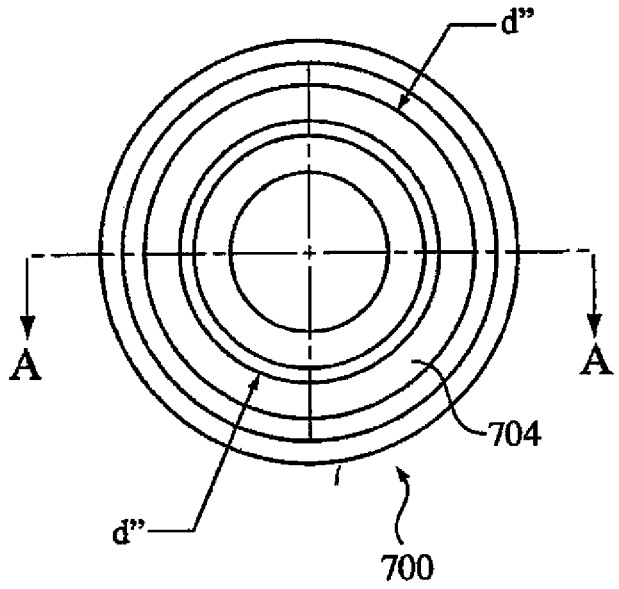
FIGS. 7*a*-7*d* show, respectively, a bottom view, a top view, a side view and a side cross-sectional view of a variant low profile cable bolt head.
Figure 7B:
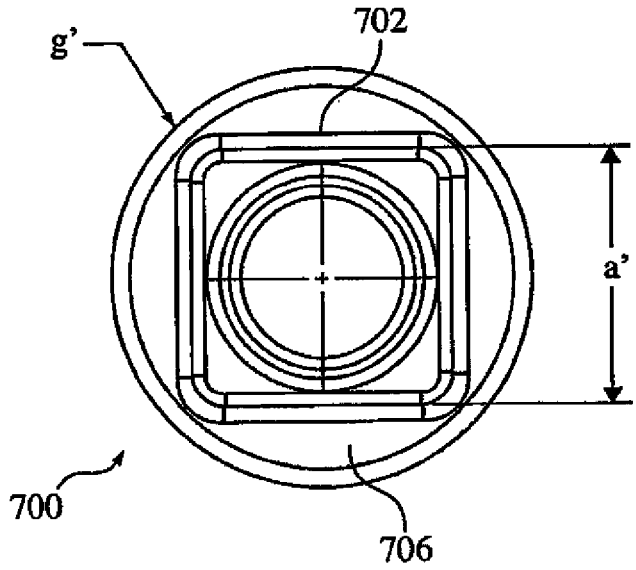
Figure 7C:
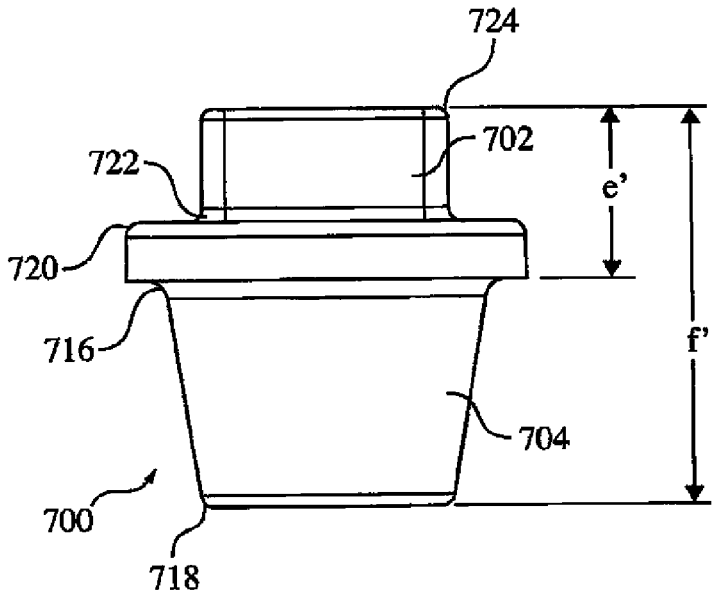
Figure 7D:
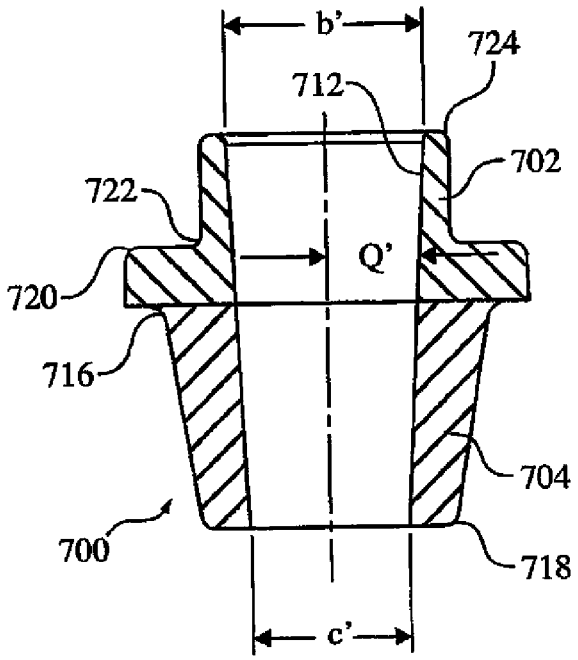

FIGS. 7*a*-7*d* present a variant embodiment that lends itself to particularly easy installation by way of a standard socket wrench. As shown, the embodiment of FIGS. 7*a*-7*b* present a cable bolt head with a generally rectilinear cross-sectional shape, or in this case a generally square cross-sectional shape. A basic tapered section is utilized similarly to that found in the "hexagonal" embodiments contemplated in accordance with FIGS. 5 and 6. Components in FIG. 7 that are analogous to those shown in FIGS. 5 and/or 6 have reference numerals advanced by 200 and 100, respectively as compared to FIGS. 5 and 6.

Accordingly, FIGS. 7*a*-7*d* show, respectively, a bottom view, a top view, a side view and a side cross-sectional view of a cable bolt head 700 in accordance with the aforementioned variant embodiment of the present invention. Reference will be made herebelow to all of FIGS. 7*a*-7*d* collectively unless otherwise indicated.

As shown, cable bolt head 700 preferably includes, a rectilinear profile portion 702 and a circular profile (or frustoconical) portion 704. Essentially, the rectilinear profile portion 702 would most often protrude downwardly from a roof while circular/frustoconical portion 704 would extend into a roof hole.

Preferably, a circular disc portion (or lip) 706 is disposed at the transition between rectilinear portion 702 and circular/frustoconical portion 704. As with the embodiment of FIG. 5, circular disc portion 706 essentially ensures that the head 700 can fit into a roof hole (or installation socket) of appropriate diameter without "over-deploying" into the hole in such a way that the head 700 would end up being disposed not sufficiently tightly or snugly against the roof.

Also shown is frustoconical throughhole 712 that preferably extends substantially all the way from an uppermost portion of head 700 to a lowermost portion, even through the transition between rectilinear portion 702 and circular/frustoconical portion 704.

As with FIG. 6, there are shown some dimensional variables (here, a' through g' as well as Q'). Again, some non-restrictive and illustrative examples of such dimensions will be provided herebelow. Again, it should further be understood that an appreciation of the relative dimensions involved, in the context of the mining arts, will certainly assist in highlighting the advantages associated with embodiments of the present invention.

By way of example, height dimension e', representing a net protrusion of head 700 beyond a roof plate, could again be merely about 0.75 inch in accordance with at least one embodiment of the present invention.

The width a' (midpoint to midpoint) of rectilinear (here square) hexagonal portion 702 could be about 1.1 inches, while an outer diameter g' of disc portion may be about 1.8 inches.

Other dimensions may be chosen and employed in a manner to provide degrees of strength and anchorage that may be desired. In a typical (albeit illustrative and non-restrictive) application, a maximum inner diameter b' of frustoconical throughhole 712 could be about 0.875 inches and a minimum inner diameter c', about 0.70 inches. A minimum outer diameter d' of circular/frustoconical portion 704, on the other hand, could be about 1.10 inches, while a maximum outer diameter d" thereof could be about 1.4 inches. A overall height dimension f' of head 700 could be about 1.75 inches, while the pitch angle Q' of hole 712 could be about 3 degrees.

As is further shown, a transitional corner 716 (between disc portion 706 and circular/frustoconical portion 704) and a terminal circular edge 718 (of circular/frustoconical portion 704) could be rounded (i.e., provided with radii). The same holds true for edges 720 and 724, as well as transitional corner 722, as shown.

Again, it will be appreciated that cable head 700 can be configured and dimensioned such that most of its length would fit inside a drilled hole in a mine roof, and would thus dig into the hole during the process of installing the cable bolt, via the drill rotation that mixes the resin.

It will be appreciated from the foregoing that the variant embodiment broadly contemplated in accordance with FIG. 7 lends itself to an improvement in the performance of a cable bolt head in its interaction with a bearing plate, in that the circular disc portion (shown as 706) acts as a flange or lip with a proportionately large bearing surface, while rounded corners and edges as just described can reduce a tearing tendency in the presence of non-axial loads.

While the variant embodiment of FIG. 7 presents a rectilinear/square profile portion for accommodating a tightening wrench, and while many conventional tightening wrenches can readily accommodate such a profile portion, it should be understood that a very wide variety of other cross-sectional profile shapes are conceivable for the same purpose. For instance, triangular, pentagonal, heptagonal or octagonal cross-sectional profiles shapes could be provided for the protruding profile portion of a roof bolt head, inasmuch as these could mate with a compatible recessed portion of a tightening wrench.

In general, a "cable bolt", as set forth and described heretofore, can be understood as being interchangeable, in accordance with at least one embodiment of the present invention, with essentially any other type of roof bolt as employed in the mining arts, such as a bolt that is not necessarily formed from cable (e.g., a solid generally cylindrical bolt or a hollowed, generally cylindrical bolt).

It should also be understood and appreciated that roof bolt assemblies as broadly contemplated herein will also preferably include wedges or other suitable arrangements to assist in securing a cable or other bolt within a throughhole of a roof bolt head so as to prevent a slipping of the cable or other bolt with respect to the roof bolt head.

Without further analysis, the foregoing will so fully reveal the gist of the embodiments of the present invention that others can, by applying current knowledge, readily adapt it for various applications without omitting features that, from the standpoint of prior art, fairly constitute characteristics of the generic or specific aspects of the embodiments of the present invention.

If not otherwise stated herein, it may be assumed that all components and/or processes described heretofore may, if appropriate, be considered to be interchangeable with similar components and/or processes disclosed elsewhere in the specification, unless an express indication is made to the contrary.

If not otherwise stated herein, any and all patents, patent publications, articles and other printed publications discussed or mentioned herein are hereby incorporated by reference as if set forth in their entirety herein.

It should be appreciated that the apparatus and method of the present invention may be configured and conducted as appropriate for any context at hand. The embodiments described above are to be considered in all respects only as illustrative and not restrictive. All changes which come within the meaning and range of equivalency of the claims are to be embraced within their scope.

What is claimed is:

1. A low profile roof bolt head comprising:

a first section adapted for insertion into a roof hole, said first section having a first end surface of the roof bolt head;

a second section adapted for accommodating a tightening tool, said second section having a second end surface of the roof bolt head; and a first throughhole portion extending through said first section and forming an opening in said first end surface for accommodating a first bolt portion;

a second throughhole portion extending through said second section and forming an opening in said second end surface for accommodating a second bolt portion;

said first section having an end portion opposite said first end surface, said first section tapering in outer cross-sectional dimension from said end portion to said first end surface;

wherein said second section has a roof plate contacting portion disposed adjacent said end portion of said first section for contacting a roof plate upon initial insertion of said first section into the roof hole and having a diameter larger than the outer cross-sectional dimension of said first section;

wherein said second section has a height dimension, in parallel to a central longitudinal axis of said roof bolt head, that is less than or equal to 0.75 inch;

wherein said first and second sections have a combined height dimension, in parallel to the central longitudinal axis of said roof bolt head, that is less than or equal to 1.75 inches;

wherein said first throughhole portion and said second throughhole portion form a common throughhole extending through said first and second sections; and wherein said throughhole has a constant slope of 3° from vertical extending from said first end surface to said second end surface.

2. A low profile roof cable bolt comprising:

a cable bolt body;

a cable bolt head disposed at an end of said cable bolt body; said cable bolt head comprising:

a first section adapted for insertion into a roof hole, said first section having a first end surface of the roof bolt head;

a second section adapted for accommodating a tightening tool, said second section having a second end surface of the roof bolt head; and a first throughhole portion extending through said first section and forming an opening in said first end surface for accommodating a first bolt portion;

a second throughhole portion extending through said second section and forming an opening in said second end surface for accommodating a second bolt portion;

said first section having an end portion opposite said first end surface, said first section tapering in outer cross-sectional dimension from said end portion to said first end surface;

a roof plate contacting portion disposed adjacent said end portion of said first section for contacting the roof plate upon initial insertion of said first section into a roof hole and having a diameter larger than the outer cross-sectional dimension of said first section;

wherein said second section has a height dimension, in parallel to a central longitudinal axis of said roof bolt head, that is less than or equal to 0.75 inch;

wherein said first and second sections have a combined height dimension, in parallel to the central longitudinal axis of said roof bolt head, that is less than or equal to 1.75 inches;

wherein said first throughhole portion and said second throughhole portion form a common throughhole extending through said first and second sections; and wherein said throughhole has a constant slope of 3° from vertical extending from said first end surface to said second end surface.

3. A method of installing a low profile roof cable bolt, said method comprising the steps of:

providing a low profile roof cable bolt comprising:

a cable bolt body; and a cable bolt head disposed at an end of the cable bolt body, the cable bolt head comprising a first section adapted for insertion into a roof hole, said first section having a first end surface of the roof bolt head, a second section adapted for accommodating a tightening tool, said second section having a second end surface of the roof bolt head, and a first throughhole portion extending through said first section and forming an opening in said first end surface which accommodates the cable bolt body, a second throughhole portion extending through said second section and forming an opening in said second end surface for accommodating a bolt portion, said first section having an end portion opposite said first end surface, said first section tapering in outer cross-sectional dimension from said end portion to said first end surface, a roof plate contacting portion disposed adjacent said end portion of said first section for contacting a roof plate upon initial insertion of said first section into the roof hole and having a diameter larger than the outer cross-sectional dimension of said first section, wherein said second section has a height dimension, in parallel to the central longitudinal axis of said roof bolt head, that is less than or equal to 0.75 inch, wherein said first and second sections have a combined height dimension, in parallel to a central longitudinal axis of said roof bolt head, that is less than or equal to 1.75 inches, wherein said first throughhole portion and said second throughhole portion form a common throughhole extending through said first and second sections; and wherein said throughhole has a constant slope of 3° from vertical extending from said first end surface to said second end surface;

disposing the cable bolt body and the first section of the cable bolt head into the roof hole; and rotating the second section of the cable bolt head with the tightening tool thereby rotating the cable bolt body within the roof hole.

4. A low profile roof cable bolt comprising:

a cable bolt body;

a cable bolt head disposed at an end of said cable bolt body;

said cable bolt head comprising:

a first section adapted for insertion into a roof hole, said first section having a first end surface of the roof bolt head;

a second section, said second section having a second end surface of the roof bolt head; and a first throughhole portion extending through said first section and forming an opening in said first end surface for accommodating a first bolt portion;

a second throughhole portion extending through said second section and forming an opening in said second end surface for accommodating a second bolt portion;

said first section having an end portion opposite said first end surface, said first section tapering in outer cross-sectional dimension from said end portion to said first end surface;

wherein said second section has a roof plate contacting portion disposed adjacent said end portion of said first section for contacting a roof plate upon initial insertion of said first section into the roof hole and having a diameter larger than the outer cross-sectional dimension of said first section;

wherein said second section has a height dimension, in parallel to a central longitudinal axis of said roof bolt head, that is less than or equal to 0.75 inch; and wherein a portion of said second section has a diameter dimension, perpendicular to and centered on the central longitudinal axis of said roof bolt head, that is greater than or equal to 1.75 inches.

* * * * *